US005327043A

United States Patent [19]

Lambert

[11] Patent Number: 5,327,043

[45] Date of Patent: Jul. 5, 1994

[54] INTERNAL MAGNETIC SHIELD-FRAME MOUNTING MEANS

[75] Inventor: Dennis C. Lambert, Leola, Pa.

[73] Assignee: RCA Thomson Licensing Corporation, Princeton, N.J.

[21] Appl. No.: 913,339

[22] Filed: Jul. 15, 1992

[51] Int. Cl.[5] ..... H01J 29/80; H01J 1/00; H01J 5/02

[52] U.S. Cl. ..... 313/407; 313/402; 313/239; 313/313; 315/85

[58] Field of Search ..... 313/402, 407, 239, 313, 313/479; 315/85; 174/35 MS

[56] References Cited

U.S. PATENT DOCUMENTS

| | | | |
|---|---|---|---|
| 2,152,201 | 3/1939 | Miles | 313/239 |
| 2,174,374 | 9/1939 | Beggs | 313/239 |
| 2,292,057 | 8/1942 | Cox | 313/239 |
| 3,346,753 | 10/1967 | Haas . | |
| 3,808,492 | 4/1974 | Nagao | 313/407 |
| 3,821,583 | 6/1974 | Steiner | 313/407 |
| 4,392,914 | 7/1983 | Takenaka et al. | 313/402 |
| 4,622,490 | 11/1986 | Benway | 313/402 |
| 4,694,216 | 9/1987 | Morrell | 313/402 |
| 4,803,306 | 2/1989 | Malmquist | 174/35 |
| 4,857,795 | 8/1989 | Wakita et al. | 313/402 |

FOREIGN PATENT DOCUMENTS

| | | | |
|---|---|---|---|
| 3606469 | 9/1987 | Fed. Rep. of Germany | 313/402 |

*Primary Examiner*—Donald J. Yusko
*Assistant Examiner*—Matthew J. Esserman
*Attorney, Agent, or Firm*—Joseph S. Tripoli; Dennis H. Irlbeck; Vincent J. Coughlin, Jr.

[57] ABSTRACT

A cathode-ray tube has a faceplate panel joined to a funnel. An internal magnetic shield is disposed within the tube and is connected to a bottom surface of a flange of a shadow mask frame. The flange of the shadow mask frame has a plurality of integral shield-retaining clips formed therein. Each of the clips overlaps at least a portion of the shield, to retain it in contact with the flange of the frame.

6 Claims, 2 Drawing Sheets

INTERNAL MAGNETIC SHIELD-FRAME MOUNTING MEANS

BACKGROUND OF THE INVENTION

The invention relates to a cathode-ray tube (CRT), having an internal magnetic shield and, more particularly, to a means for attaching the shield to a frame of a shadow mask.

A color CRT typically has a magnetic shield to reduce the influence of magnetic fields on electron beam trajectories as a cathodoluminescent screen of the tube is scanned. In particular, the angles of incidence of the electron beams at every point on the shadow mask must not change significantly from the design values, or the beams will move away from their intended landing positions on the screen. The magnetic shield may be disposed either outside the tube, as an external magnetic shield, or inside the tube, as an internal magnetic shield.

The internal magnetic shield is usually made of 0.10 to 0.18 mm thick cold-rolled steel, and is fastened to a shadow mask frame by resilient clamping pins which are inserted through aligned apertures disposed in the shield and the frame. The frame is supported by springs that engage mounting studs that extend inwardly from a rectangular glass faceplate panel of the tube. During tube fabrication, the internal magnetic shield is fastened to the frame, by the clamping pins, prior to the step of frit sealing a sidewall of the faceplate panel to a glass funnel of the CRT. The internal magnetic shield is designed to fit into the funnel and to be as close to the funnel wall as possible. However, it should not touch the funnel, in order to avoid any friction between the shield and a conductive anode coating on the inner surface of the glass funnel. Additionally, the shield must be attached securely to the frame, without any significant gaps therebetween, to ensure good magnetic coupling and to prevent overscanned electrons of the beams from passing between the shield and the frame and being scattered to the screen.

One drawback of the clamping pins is that their use requires careful alignment of the corresponding apertures formed in the shield and the frame. Typically, the pins are inserted by hand, thus adding additional labor and cost to the manufacture of the CRT. Also, improperly inserted pins may loosen or become dislodged during handling of the tube, resulting in a change in location of the shield and a resultant change in its magnetic shielding properties, causing misregister of the electron beams with the phosphor elements of the screen. In extreme cases where a pin becomes dislodged, the loose pin may cause electrical failure of the CRT.

A need therefore exists for an improved means of attaching the internal magnetic shield to the shadow mask frame to avoid the above-described problems associated with clamping pins.

SUMMARY OF THE INVENTION

A cathode-ray tube has a faceplate panel joined to a funnel. An internal magnetic shield is disposed within the tube and is connected to a bottom surface of a flange of a shadow mask frame. The flange of the shadow mask frame has a plurality of integral shield-retaining clips formed therein. Each of the clips overlaps at least a portion of the shield, to retain it in contact with the flange of the frame.

DETAILED DESCRIPTION OF THE PREFERRED EMBODIMENT

Figure 1:
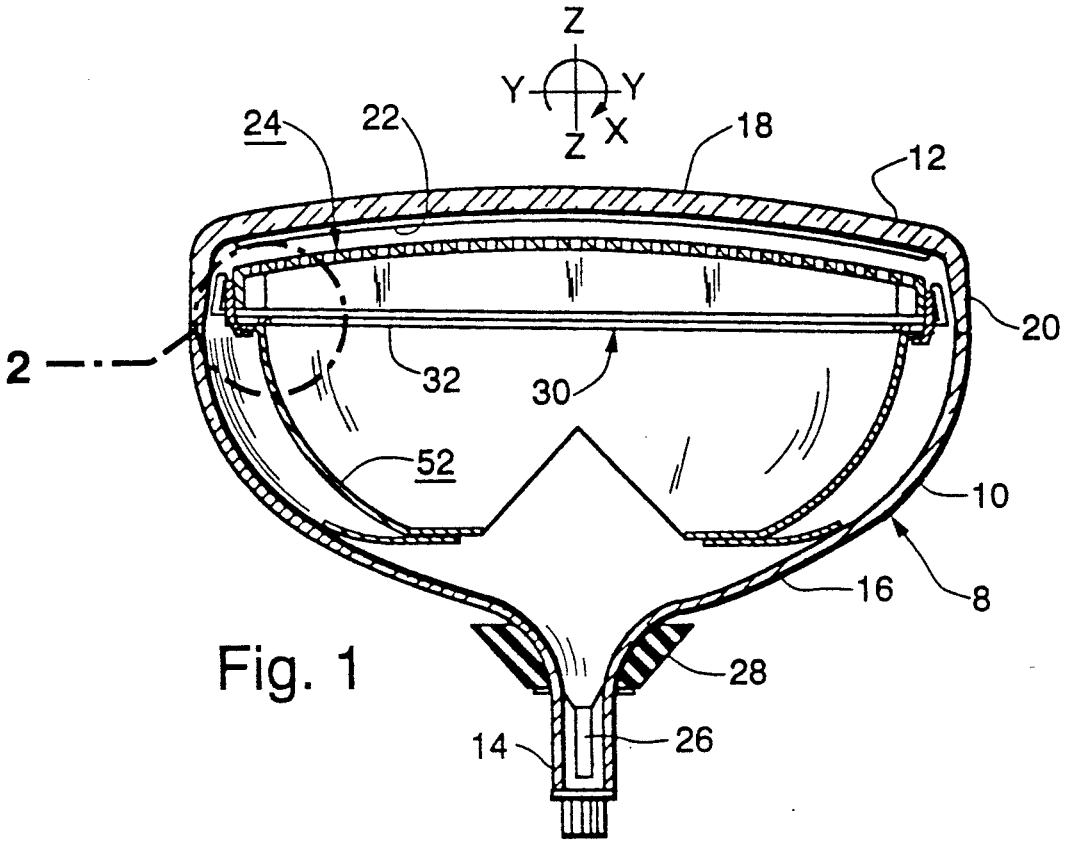
FIG. 1 is an axially sectioned view of a color CRT embodying the present invention.

FIG. 1 shows a rectangular color CRT, e.g., a TV picture tube, 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X—X, parallel to its wider dimension (usually horizontal), and a minor axis Y—Y, parallel to its narrower dimension (usually vertical). The major and minor axes are perpendicular to a central longitudinal axis Z—Z of the tube which passes through the center of the neck 14 and the center of the panel 12. A mosaic three-color phosphor screen 22 is carried on an inner surface of the faceplate 18. The screen preferably is a line screen with the phosphor lines extending substantially parallel to the minor axis Y—Y. Alternatively, the screen may be a dot screen. A multi-apertured color selection electrode or shadow mask 24 is removably mounted in predetermined spaced relation to the screen 22. An electron gun 26 is centrally mounted within the neck 14, to generate and direct three electron beams along convergent paths through apertures in the mask 24 to the screen 22.

The tube 8 is designed to be used with an external magnetic deflection yoke, such as yoke 28, located in the vicinity of the funnel-to-neck junction. When activated, the yoke 28 subjects the three beams to magnetic fields which cause the beams to scan horizontally and vertically in a rectangular raster over the screen 22.

Figure 3:
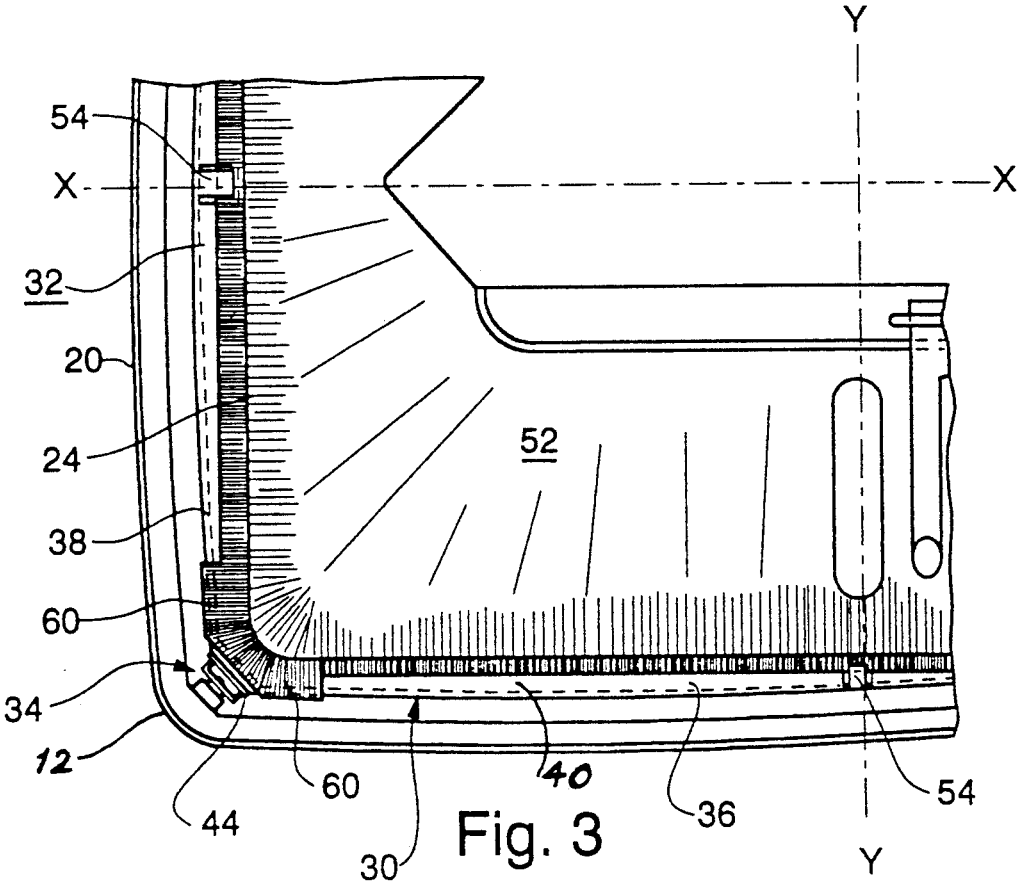
FIG. 3 is a bottom view of a quadrant of the faceplate and mask-frame assembly of the tube of FIG. 1.

The shadow mask 24 is part of a mask-frame assembly 30 that also includes a peripheral frame 32. The mask-frame assembly 30 is shown positioned within the faceplate panel 12 in FIGS. 1 and 3. The mask-frame assembly 30 is mounted within the panel 12 by four support means 34, one of which is shown in FIG. 3.

Figure 2:
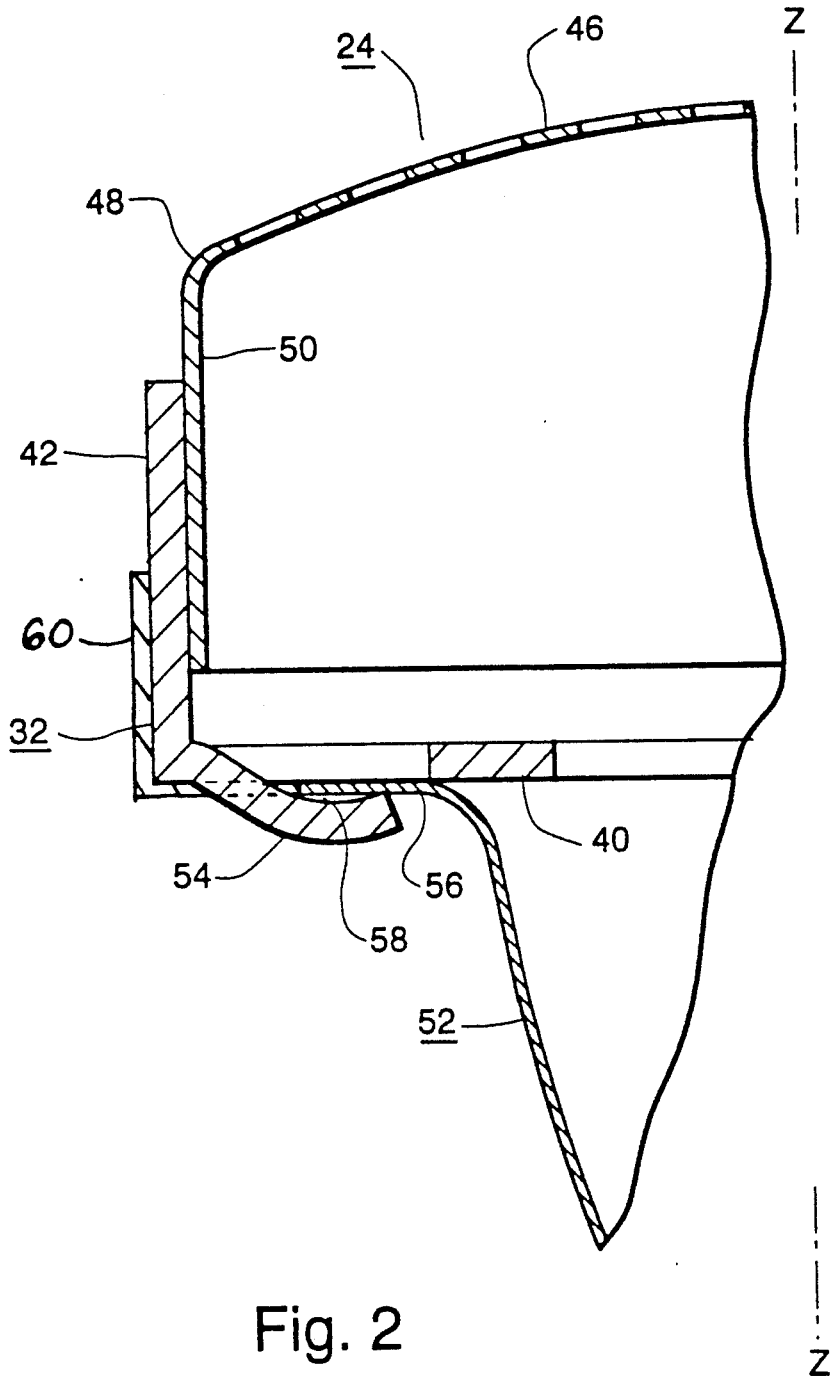
FIG. 2 is an enlarged view of a section shown within the circle 2 of FIG. 1.

The frame 32 is substantially rectangular having two oppositely disposed long sides 36 (only one of which is shown) which are parallel to the major axis X—X, and two short sides 38 (one of which is shown) which are parallel to the minor axis Y—Y. With reference to FIG. 2, each of the sides 36 and 38 of the frame 32 includes two substantially perpendicular flanges, a first or bottom flange 40 and a second or top flange 42, in an L-shaped cross-sectional configuration. The first flange 40 is generally orthogonal to the central longitudinal axis Z—Z and the second flange 42 extends from the first flange 40 parallel to the central longitudinal axis Z—Z, toward the screen 22. The four corners 44 of the frame 32 are truncated, being angled approximately perpendicular to the diagonal direction of the frame.

The shadow mask 24 includes a curved apertured portion 46, imperforate border portion 48 surrounding the apertured portion 46, and a skirt portion 50 bent back from the border portion 48 and extending away from the screen 22. The mask 24 is telescoped within or set inside the frame 32 and attached, for example by welding, to the inside surface of the second flange 42.

An internal magnetic shield 52 is attached to the bottom surface of the first flange 40 by means of a plurality of novel retaining clips 54 which are integral with the flange 40. The clips 54 are formed by punching, or otherwise piercing, the first flange 40 to raise the clips from the body of the flange. As shown in FIG. 2, each of the clips 54 overlaps at least a portion of a shoulder 56 of the shield 52. At least one clip 54 is formed in each side of the frame 32, preferably in line with the major and minor axes. The clips 54 are raised above the bottom of the first flange 40 to provide a cavity 58, directed toward the central longitudinal axis Z—Z, into which the shoulder 56 of the shield 52 fits. The shield 52 has considerable spring-back so it provides an outwardly directed force to retain the shoulder 56 within the cavity 58. As shown in FIGS. 2 and 3, portions 60 of the shield 52 are located adjacent to the corners 44 of the frame 32. The portions 60 overlap the first flange 40 and extend along the outer surface of the second flanges 42 to locate and further secure the shield 52 to the frame 32.

While only one clip 54 is shown on each side of the frame 32 in FIG. 3, several clips may be utilized along each side of the frame to secure the shield 52. This is especially true in larger size tubes where one clip on each side of the frame may be insufficient to adequately hold the shield closely to the frame. Because the thickness of the shield material is within the range of 0.10 to 0.18 mm, the clips 54 are spaced at least 0.20 mm above the bottom surface of the first flange 40 to provide adequate clearance. But the spacing must not be too great, or it will reduce the magnetic coupling and permit overscanned electrons to penetrate between the shield and the frame, and strike the screen 22. The novel clips 54 lend themselves to automated assembly of the shield to the mask-frame assembly 30, because slight inwardly directed pressure on the sides of the shield 52 is sufficient to compress the sidewall of the shield without bending or distorting it, and its spring-back causes it to return to its original shape after its shoulders have been inserted into the cavity 58 formed between the bottom of flange 40 and the clips.

While the clips 54 are shown in FIG. 3 as having a substantially rectangular shape, the invention is not so limited, and the clips may assume any shape that is convenient to the frame piercing and forming procedure.

What is claimed is:

1. In a cathode-ray tube having a faceplate panel joined to a funnel and having an internal magnetic shield connected to a bottom surface of a flange of a shadow mask frame, the improvement comprising said flange of said shadow mask frame having a plurality of integral shield-retaining clips formed therein, wherein each of said shield-retaining clips being formed from said flange of said frame by piercing said flange to raise said clips out of the body of said flange, thereby providing a cavity directed toward a central longitudinal axis of said tube to retain a shoulder of said shield therein, each of said clips overlapping at least a portion of said shield to retain said shield in contact with said flange of said frame.

2. In a cathode-ray tube having a faceplate panel joined to a funnel thereof along a sidewall of said panel, and having an internal magnetic shield disposed therein proximate an inner surface of said funnel and connected to a bottom surface of a first flange of a shadow mask frame, said first flange being oriented orthogonally to a central longitudinal axis of said tube, a multi-apertured shadow mask being connected along an edge thereof to a second flange of said shadow mask frame which is generally aligned parallel to said central longitudinal axis, the improvement wherein said first flange of said shadow mask frame having a plurality of integral shield-retaining clips formed therein by piercing said first flange to raise said clips from the body of said flange thereby providing a cavity directed toward said central longitudinal axis of said tube, each of said clips overlapping a shoulder of said shield to retain said shield within said cavity and in contact with said first flange of said frame.

3. The tube as described in claim 2, wherein said frame is substantially rectangular having two oppositely disposed long sides and two short sides, each side having at least one of said retaining clips formed therein.

4. The tube as described in claim 3, wherein said long sides of said frame are parallel to a major axis of said tube and said short sides are parallel to a minor axis of said tube, one of said retaining clips being formed in each of said sides of said frame and being aligned with said major and minor axes.

5. The tube as described in claim 2, wherein said shield includes a plurality of portions which overlap said first flange of said frame and extend along said second flange thereof.

6. The tube as described in claim 5, wherein said portions of said shield being located adjacent to the four corners of said frame to locate and further secure said shield to said frame.

* * * * *